US005743165A

United States Patent [19]

Tanaka et al.

[11] Patent Number: 5,743,165

[45] Date of Patent: Apr. 28, 1998

[54] METHOD FOR CONTROLLING DRIVING OF A RAM OF A HYDRAULIC CYLINDER OF A HYDRAULIC PRESS EQUIPMENT

[75] Inventors: Hirohisa Tanaka, Tokyo; Takeshi Nagata, Aichi, both of Japan

[73] Assignee: Nisshinbo Industries, Inc., Tokyo, Japan; by said Takeshi Nagata

[21] Appl. No.: 567,124

[22] Filed: Dec. 4, 1995

[30] Foreign Application Priority Data

Dec. 20, 1994 [JP] Japan ..... 6-335501

[51] Int. Cl.[6] ..... F15B 11/048

[52] U.S. Cl. ..... 91/419; 91/454; 91/461

[58] Field of Search ..... 91/419, 435, 454, 91/461, 462

[56] References Cited

U.S. PATENT DOCUMENTS

| | | | |
|---|---|---|---|
| 3,973,595 | 8/1976 | Schmoll | 91/461 X |
| 4,537,547 | 8/1985 | Cole | 91/435 X |
| 4,579,042 | 4/1986 | Neff | 91/461 X |
| 4,796,428 | 1/1989 | Hall | 91/435 X |
| 4,813,335 | 3/1989 | Wakiya et al. | 91/462 X |
| 5,287,794 | 2/1994 | Andersson | 91/461 X |

*Primary Examiner*—F. Daniel Lopez
*Attorney, Agent, or Firm*—Kubovcik & Kubovcik

[57] ABSTRACT

It is possible for the present invention to operate with the optimal control to prevent a ram from overshooting in a case that a load acting on the ram is decreasing rapidly, like a stamping machining process. Linking a hydraulic circuit which consists of a hydraulic pump 3 and a hydraulic cylinder 2 to make the ram 1 for the hydraulic press equipment move upward and downward and a full-bridge hydraulic circuit with four proportional sheet valves V1 through V4, the working timings of the proportional sheet valves V1 through V4 are controlled by a NC controller 9. In the normal operation, operating the proportional sheet valves V2 and V3 with the turn-on-off control system and with the meter out control system, oil pressure PU acting on the upper chamber 2U of the hydraulic cylinder 2, driving the ram 1 by the piston 10 moving downward, a work is stamped out. The NC controller 9 detects the running by inertia of the ram 1 in the instance of having stamped out a work in the stamping out machining process. As soon as the NC controller 9 detects the rapidly large speed fluctuation by a speed detecting sensor, the NC controller 9 commands the pilot valve 8 of the proportional sheet valve V1 in order to prevent the running by inertia of the ram 1 by controlling the back pressure PL of the lower chamber 2L of the hydraulic cylinder.

2 Claims, 7 Drawing Sheets

METHOD FOR CONTROLLING DRIVING OF A RAM OF A HYDRAULIC CYLINDER OF A HYDRAULIC PRESS EQUIPMENT

BACKGROUND OF INVENTION

The present invention relates to a method for controlling driving of a ram of a hydraulic cylinder of a hydraulic press equipment.

Generally a driving control of a hydraulic cylinder for driving a ram for hydraulic press equipment has been applied to a hydraulic circuit comprising servo valves and hydraulic circuit directional control valves such as four-port spool valves and an equivalent bridge hydraulic circuit consisting of four logic valves.

In the driving control of the hydraulic cylinder using a four-port spool valve, an opening rate of four throttle valves controlling flow rate is mechanically determined from displacement of the spool, so that an operation pressure of the hydraulic cylinder can not be set up freely. In a case that a cross-section of an upper chamber of the hydraulic cylinder is not equal to a cross-section of a lower chamber of the hydraulic cylinder, it has a fault that it is necessary to use an exclusive valve which has the characteristics of the flow ratio of an upper chamber and a lower chamber of the spool. It is able for a servo valve to operate proportional control of the flow rate. It has a weak point that the servo valve is very expensive and has a characteristic of pressure losses being large.

On the other hand, in the driving control of a hydraulic cylinder using a logic valve, it is able to control individually opening rates of four throttle valves of a hydraulic bridge circuit. It is difficult for a logic valve to operate on proportional control of a very small flow rate. It is a defect that it is difficult for a logic valve to operate on speed adjustment control of the hydraulic cylinder.

Generally in the conventional hydraulic press the hydraulic circuit and the control method have a fixed setting and they are not changed depending on the load. The energy efficiency is very bad because its output and speed are larger than it needs.

It is desired to develop a driving control method that in order to operate continuously on speed adjustment control of the hydraulic cylinder for driving the ram for hydraulic press equipment, it is possible to control the oil pressure continuously in ranges of flow rates from small to large, to have general flow characteristics being independent from kinds of hydraulic cylinders, and to set up desired characteristics freely and to change characteristics by control means such as NC controllers. It is also desired for a control method to select suitable hydraulic circuits and control methods dependent on condition of loads.

SUMMARY OF THE INVENTION

These and other objects have been accomplished by the method for controlling driving of a ram of a hydraulic cylinder of a hydraulic press equipment of the present invention. We have discovered a method for controlling driving of a ram of a hydraulic cylinder of a hydraulic press equipment, wherein four proportional sheet valves are connected with a hydraulic circuit so as to form a full-bridge hydraulic circuit, said hydraulic circuit comprise a hydraulic pump and a hydraulic cylinder to make said ram of said hydraulic press equipment move upward and downward, each of said proportional sheet valves comprises a sheet-formed main valve and a pilot valve for controlling motions of said main valve, characterized in that; in case of a machining process with a wide load fluctuation like a stamping machining process, operating rapidly to turn on one of said proportional sheet valves which is in a pressure oil supply position, by flowing pressure oil into a lower chamber of said hydraulic cylinder as soon as a stamping load decreases rapidly, and supplying pressure oil into a lower chamber of said hydraulic cylinder in order to prevent said ram from overshooting a target position.

The method for controlling driving of a ram of a hydraulic cylinder of a hydraulic press equipment according to the present invention may comprise the steps of: setting up a pair of proportional sheet valves being in a pressure oil supply position with turn-on and a remaining pair of proportional sheet valves being in a pressure oil delivery position with turn-off, respectively, which enables selecting a hydraulic circuit combination, in which a working speed of said hydraulic cylinder takes precedence of all other operating conditions, in accordance with a calculated working load from an operating control means like NC controllers, and in case of a necessary working load being larger than a calculated working load, detecting moving speed of said ram, then setting up one of a pair of proportional sheet valves being in pressure oil supply position with turn-off and a remaining pair of proportional sheet valves being in a pressure oil delivery position with turn-on, respectively, just before stopping of said ram, whereby enabling changing the hydraulic circuit combination.

DETAILED DESCRIPTION OF THE PREFERRED EMBODIMENT

The description of the preferred embodiment of the present invention will be explained hereinafter in detail by figures.

Figure 1:
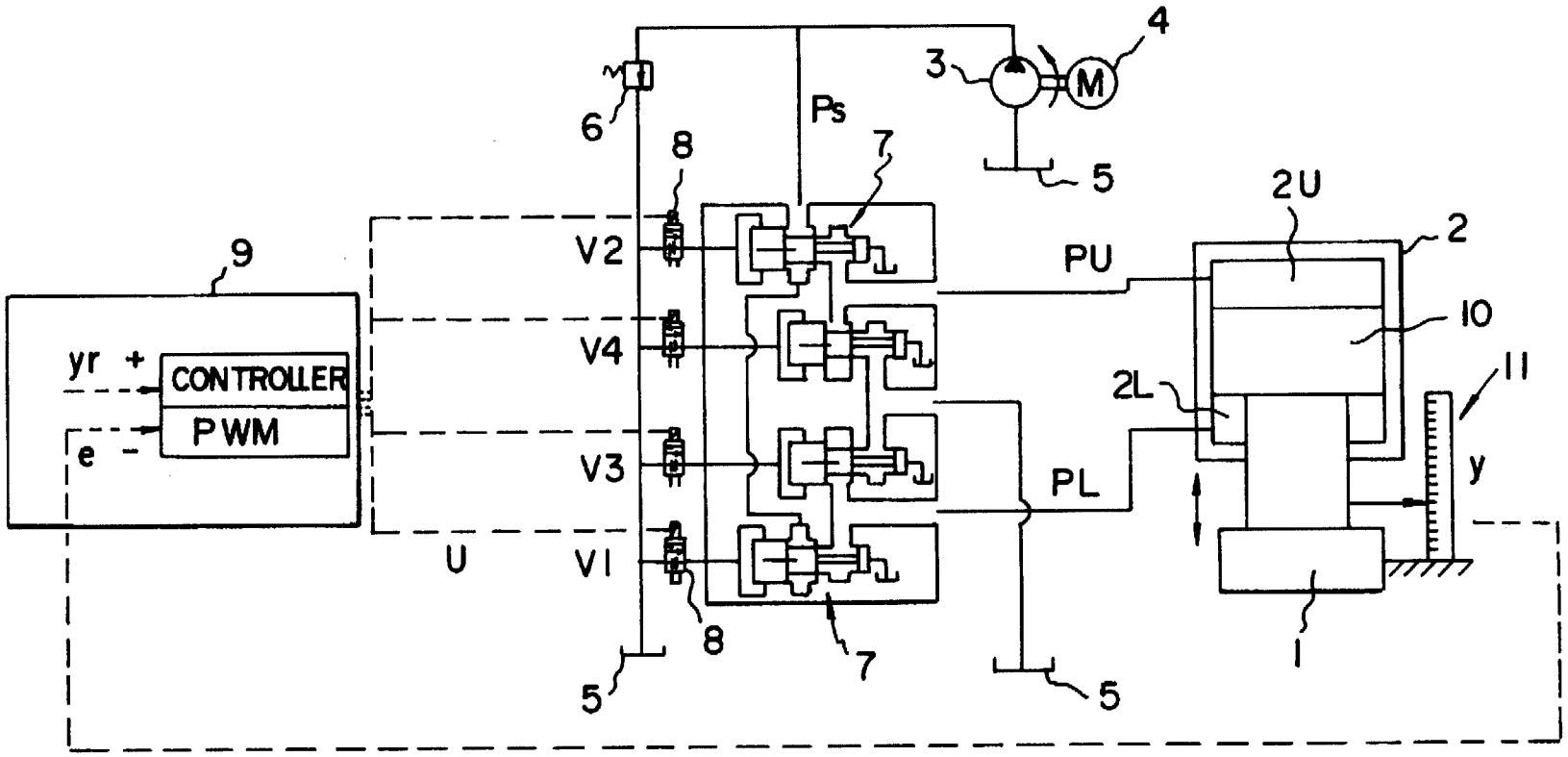
FIG. 1 shows an example of a hydraulic circuit driving control method of a ram driving hydraulic cylinder for a hydraulic press equipment adopting the method of the present invention.

FIG. 1 shows a example of a hydraulic circuit adopting the driving control method of a ram driving hydraulic cylinder for a hydraulic press equipment adopting the present invention. In FIG. 1, number 1 is a ram, number 2 is a hydraulic cylinder, number 3 is a hydraulic pump, number 4 is a motor driving the hydraulic pump, number 5 is an oil tank, and number 6 is a relief valve.

A full-bridge hydraulic circuit consisting of four proportional sheet valves V1, V2, V3, and V4 is set up in a hydraulic circuit made by pipe arrangements linking said components. The proportional sheet valves V1 through V4 which consist of sheet-formed main valves 7 and pilot valves 8 using high speed electromagnetic valves are able to control the opening ratios of the pilot valves 8 by a NC controller 9. A position of a piston 10 is detected by a sensor 11. (FIG. 1 shows a general concept of sensing positions and an actual sensor is not illustrated.) The piston position signal is to be fed back to the NC controller 9. The piston 10 of the hydraulic cylinder 2 is able to move upward in FIG. 1 when operating the valves V1 and V4. The piston 10 is able to move downward in FIG. 1 when operating the valves V2 and V3.

Figure 2:
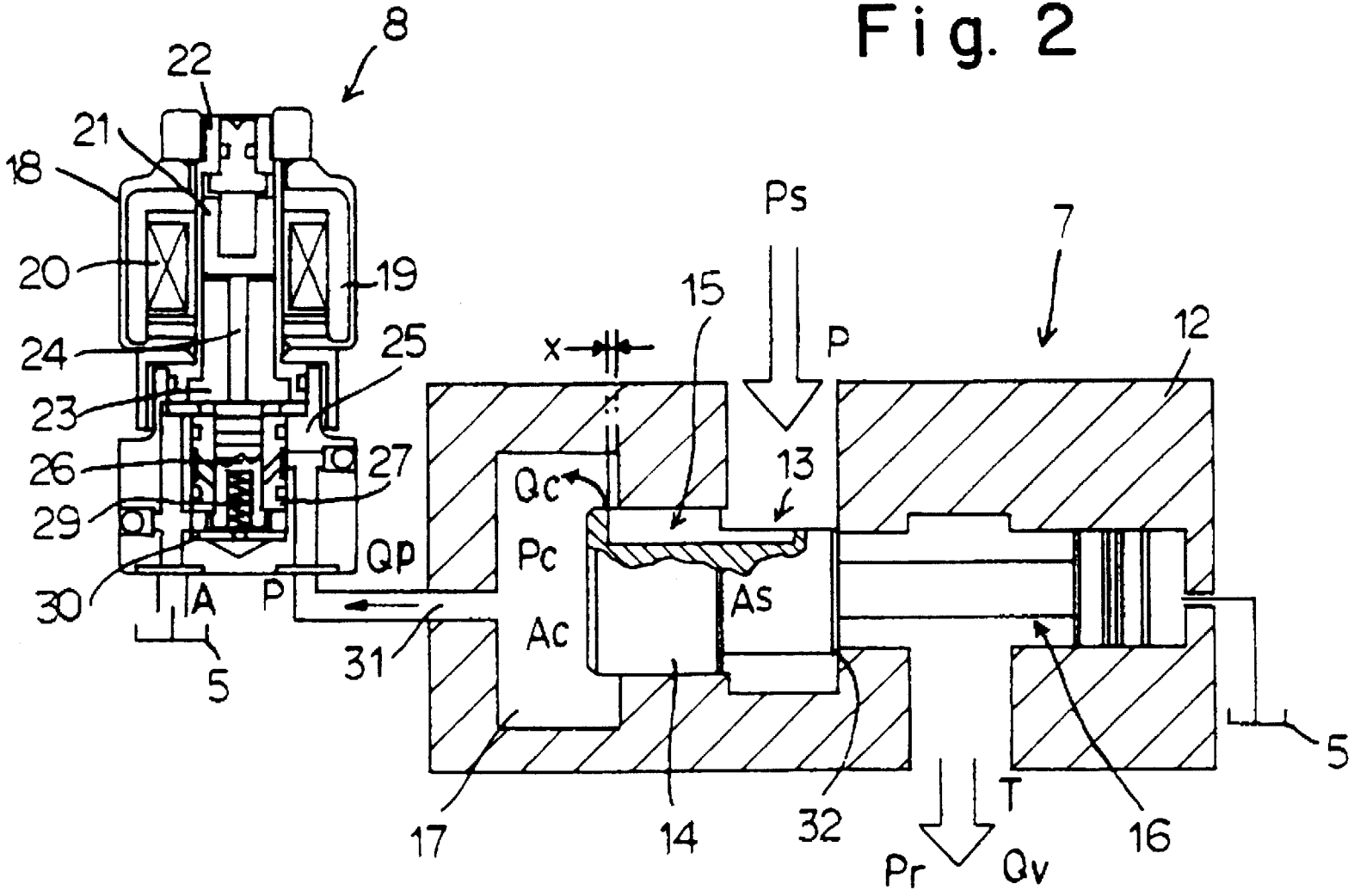
FIG. 2 shows an enlarged cross-section illustration of the proportional sheet valve adopting the present preferred embodiment of FIG. 1.

FIG. 2 shows an enlarged cross sectional illustration of components of the proportional sheet valves V1 through V4 in FIG. 1. The main valve 7 has a P-port and a T-port in a body 12, including a spool 13 in the body 12. The spool 13 forms a feed-back flow channel 15 in a part of a land 14. (its throttling is in series and its width is Wc.) The spool 13 also has a spool balance 16. The feed-back flow channel has an under lap X with a control volume 17 in the body 12.

The pilot valve 8 is a normal closed two-port valve, whose upper part body 18 has a yoke 19, a plunger 21, a tube 22, a stator 23, and a push-pin 24, whose lower body 25 has a poppet valve 26, a sleeve 27, a spring 29, and a stopper 30. The pilot valve 8 is able to open and to shut the flow channel between the P-port and A-port by driving the poppet valve 26 by the turn-on-off control of a solenoid 20. The port 31 set up with the control volume 17 of the main valve 7 is connected with the P-port of the pilot valve 8.

In the proportional sheet valves V1 through V4 consisting of the above mentioned components, under the shutting condition of the pilot valve 8 the supply oil pressure Ps is equal to the oil pressure Ps of the control volume 17 through the feed-back flow channel 15. The proportional sheet valves V1 through V4 maintain the valve shut-off condition because of the spool 13 being pressed on the valve sheet 32 by the relation of the acting area of the land 14. (where a cross-section of acting area of the control volume 17 is Ac and a cross-section of acting area of the supply pressure is Ap.) In this condition, the electric power is on the solenoid 20 of the pilot valve 8, the plunger 21 is absorbed into the stator 23, pushing the push pin 24, making the poppet valve 26 open, the oil flowing from the P-port to A-port through the inclined flow channel of the sleeve 27 and the throttle part of the poppet valve 26. Opening the poppet valve 26 of the pilot valve 8, the oil flows out from the control volume 17 of the main valve 7 through the port 31, the oil pressure Pc of the control volume 17 being lower, becoming equal to the oil pressure on the acting area of the land part 14, the spool 13 moving leftward in FIG. 1, and holding the valve open.

When the delivery flow rate (the pilot flow rate) from the port 31 of the control volume 17 is equal to the flow rate Qc of the feed back flow channel 15, the oil pressure acting on the acting area of the land part 14 is balanced again, and the spool 13 stops. Therefore positioning of the spool 13 of the main valve 7 is controlled dependent on the opening ratio of the pilot valve 8 and it is possible to gain a large flow rate Qv in proportional to the pilot flow rate Qp by controlling the pilot flow rate with a small flow rate. When the electric power is off to the solenoid 20 of the pilot valve 8, the poppet valve 26 is returned to the ordinary normal position by the spring 29 and is completely shut off.

In the proportional sheet valves V1 through V4 as shown in FIG. 1 it is easy for the spool 13 and the pilot flow rate Qp to cause fluctuation in range of the valve opening ratio that is small in influence to the load pressure. Then, as it is not illustrated, the drain hydraulic circuit of the pilot valve 8 is open to the atmosphere, it is set up not to be influenced from the load pressure by arranging a balance spool 16 to the main valve 7.

Figure 3:
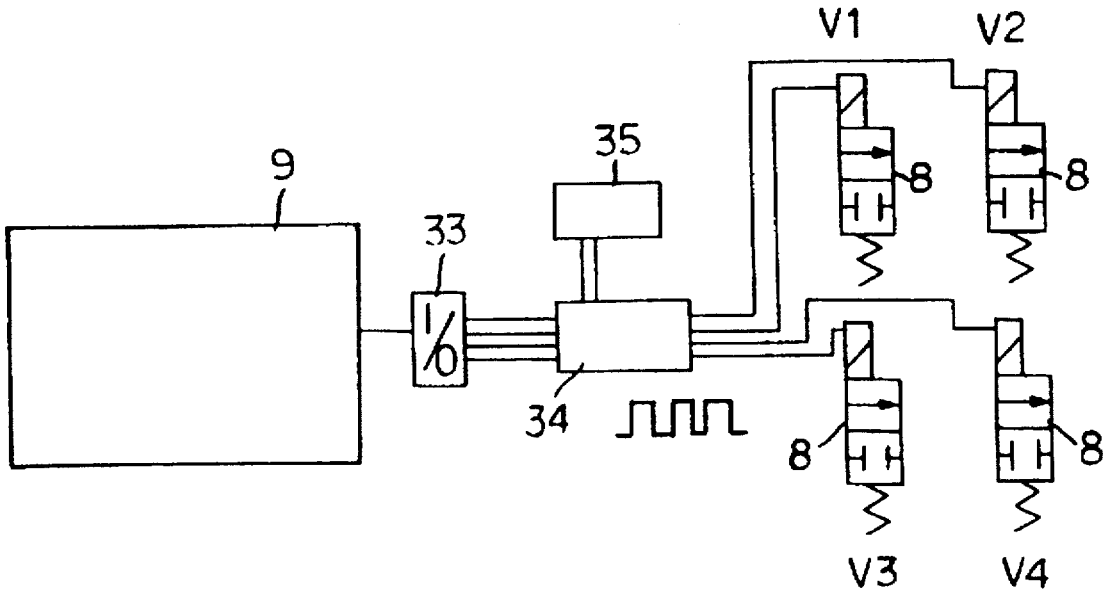
FIG. 3 shows a general concept of a connecting diagram of the pilot valve of a proportional sheet valve and the NC controller as shown in FIG. 1.

FIG. 3 shows a general concept of connecting the NC controller 9 and the pilot valve 8 of the proportional valves V1 through V4. In FIG. 3 number 33 is an I/O port, number 34 is a high speed driving circuit, number 35 is a direct current power equipment (for example, +24 volts), the NC controller selects the proportional sheet valves and outputs a operation command pulse signal to each circuit of each pilot valve 8 from the I/O port 33 through the high speed driving circuit.

The operation of the present preferred embodiment will be explained. In the present preferred embodiment the full-bridge hydraulic circuit consists of four proportional sheet valves V1 through V4, and controls each operating timing of each proportional sheet valve V1 through V4. The control conditions comprises three steps:

(1) in a case of controlling a turn-on-off control system being in the oil supply position of the proportional sheet valves V1 through V4, and meter-out control being in the oil delivery position;

(2) in a case of the load variation being very large like a stamping machining process;

(3) in a case of controlling automatically whether a high speed operation or a large output operation independent from the load.

The above mentioned control conditions will be explained in order. The operation will be explained hereinafter in cases of controlling a turn-on-off control system of the proportional sheet valves V1 and V2 being in the oil supply position and of controlling a meter-out control controlling proportionally the proportional sheet valves V3 and V4 being in the oil delivery position by PWM control.

The NC controller selects opening the proportional sheet valves V1 through V4 in relation with the input signal voltage corresponding to the target oil cylinder displacement yr (in a case of the feed back control it is the controlling difference e corresponding to the hydraulic cylinder displacement y,) and the modulation ratio outputting to each pilot valve 8. The NC controller outputs the input signal U as an operation command signal of the exciting circuit of each pilot valve 8 by the I/O port 33.

Figure 4:
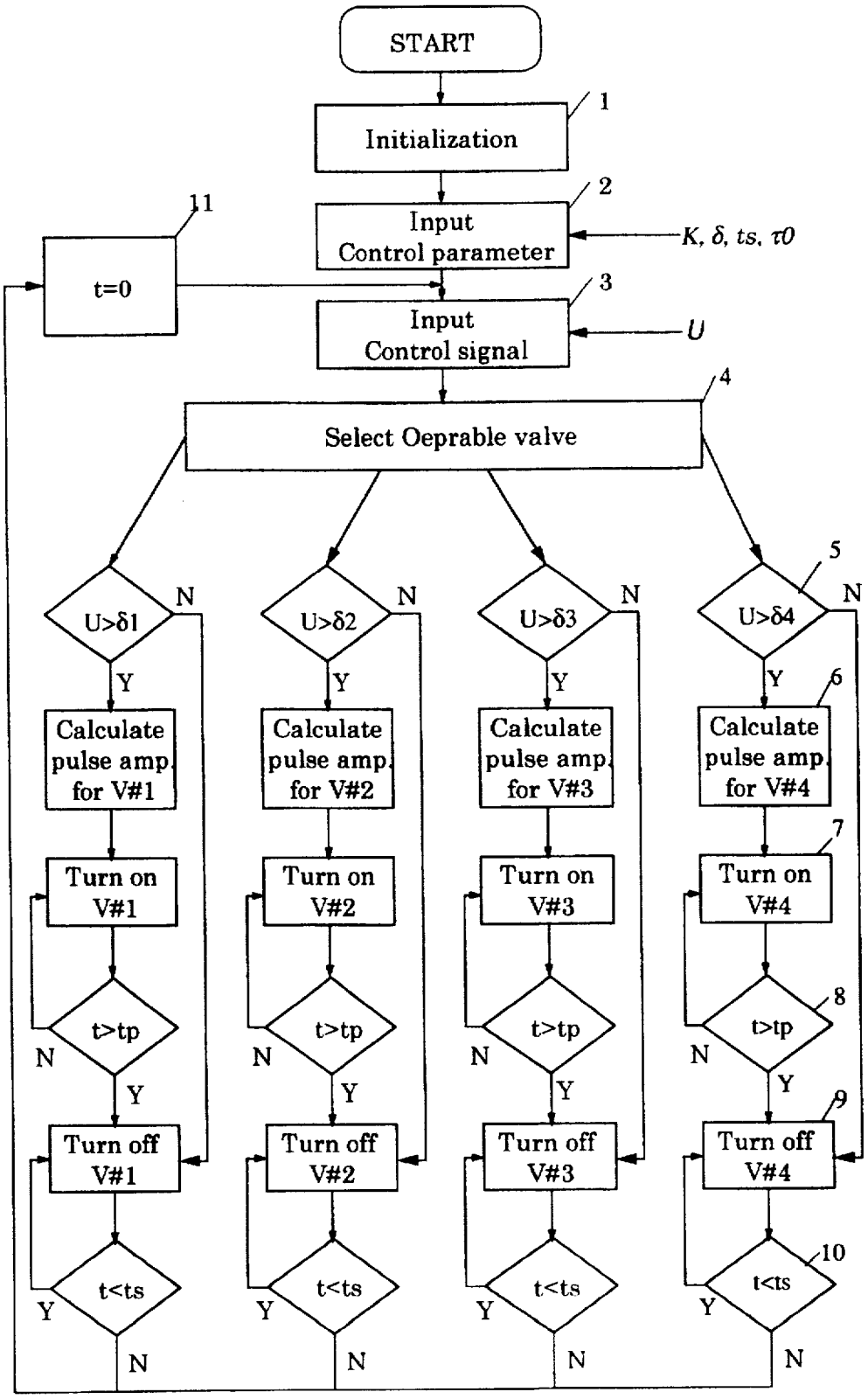
FIG. 4 shows simply a flow chart of the control program of the control method adopting the present preferred embodiment.

In a concrete form each pilot valve 8 is controlled by the operation program of the flow chart as shown in FIG. 4 in steps in:

step 1, at first initializing after start;

step 2, inputting the initial control parameters conditions to the pilot valves 8 of the proportional sheet valves V1 through V4, so that the initial setting parameters are a PWM gain K, a blind zone width $\delta$, a PWM control sampling period ts, a minimum modulation degree or a threshold $\tau 0$;

step 3, inputting an input signal U;

step 4, selecting opening of the pilot valves 8 in relation with the modulation degree outputting each pilot valve 8 and with the input signal U;

step 5, for example, in step four of selecting the turn-on pilot valves 8 of the proportional sheet valves V1 and V3, comparing the blind zone width $\delta 1$ and $\delta 3$ with the input signal U respectively;

step 6, calculating a pulse width giving each pilot valve 8 when the input signal U is larger than a blind zone width $\delta 1$ and $\delta 3$;

step 7, making the pilot valve 8 turn-on with the proportional sheet valves V1 and V3;

step 8, comparing the lapse time from the turn-on with the PWM controlling pulse period width tp;

step 8, becoming the condition, t>ts;

step 9, making each pilot valve 8 turn-off in the above condition;

step 10, the lapse time from turn-off being longer than the PWM sampling period ts;

step 11, setting up the lapse time t to zero, and returning to step 3.

In step 5 if the input signal U is smaller than the blind zone width δ1 and δ3, then operation process flows to step 9, and the pilot valves 8 of the proportional sheet valves V1 and V3 are set up to turn-off.

The flow discharge characteristics of controlling the proportional sheet valves V1 through V4 consisting of a full-bridge circuit in above mentioned flow chart will be explained. At first, a general full-bridge control system will be considered. The flow discharge characteristics of the spool valve with a 4-ports zero lap valve consisting of a general full-bridge control system is calculated from the following equation, $$Q_L = C_d \pi d x_v \sqrt{\frac{P_S - P_L}{\rho}} \tag{1}$$

where QL is a load flow rate, PL is a load oil pressure, d is a diameter of the valve, and Xv is an opening ratio of the main valve. Normalizing the above equation by the following terms, $$\overline{Q_L} = \frac{Q_L}{Q_{sM}} \tag{2}$$

$$\overline{P_L} = \frac{P_L}{P_s} \tag{3}$$

$$G_{vM} = C_d \pi d x_v \sqrt{\frac{2}{\rho}} \tag{4}$$

$$G_{vM} = C_d \pi d x_{vmax} \sqrt{\frac{2}{\rho}} \tag{5}$$

$$\overline{G_v} = \frac{G_v}{G_{vM}} \tag{6}$$

$$Q_{sM} = G_{vM} \sqrt{\frac{P_s}{2}} \tag{7}$$

Figure 5:
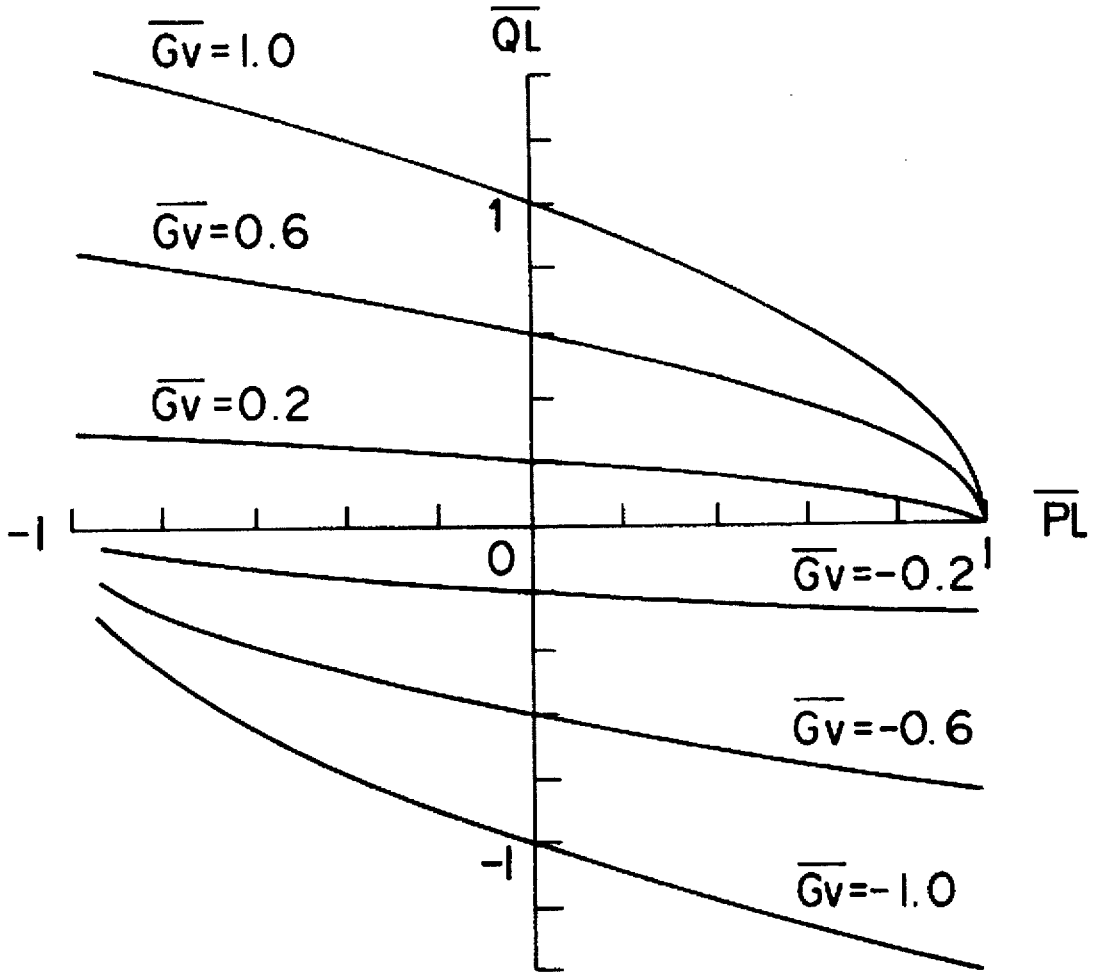
FIG. 5 shows characteristics between the load pressure and the flow rate of four-port-zero-lap spool valve.

FIG. 5 shows the relations of the normalized flow rate QL flowing actually and the normalized oil pressure difference under the constant valve opening rate condition of each valve. The reference flow rate Qs M is equal to the maximum flow rate under the maximum opening rate condition of 4-port zero lap valve. The output power Wv of the valve is obtained from the following relation, $$W_v = P_L Q_L \tag{8}$$

Using the differential equation, $$\frac{dW_v}{dP_L} = 0 \tag{9}$$

the maximum output condition of the valve is gained from the following equations, $$P_L = \frac{2}{3} P_s \tag{10}$$

The maximum output power Wvmax is calculated from the following equation, $$W_{vmax} = \frac{2\sqrt{3}}{9\sqrt{\rho}} C_d \pi d P_s^{1.5} \tag{11}$$

Figure 6:
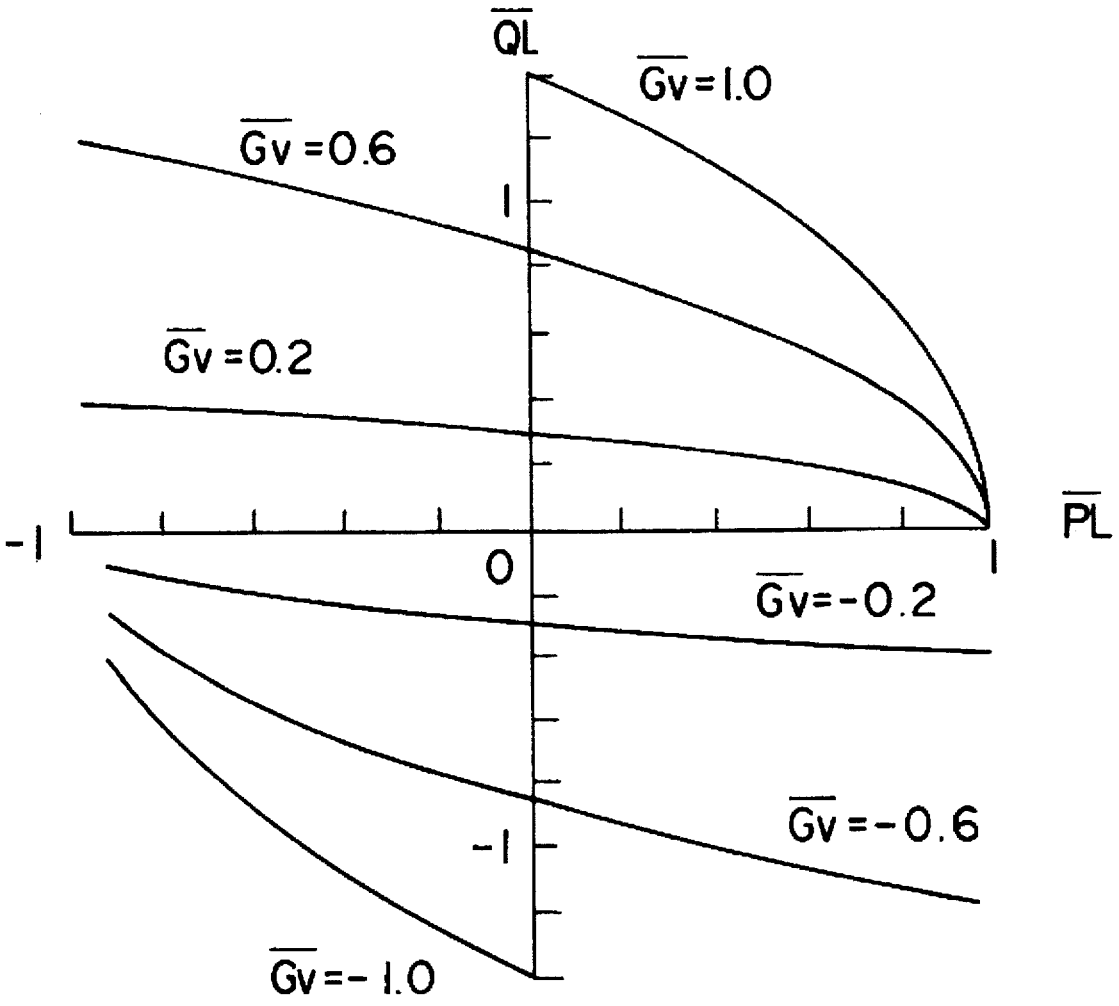
FIG. 6 shows characteristics between the load pressure and the flow rate of the full-bridge proportional sheet valve.

The control system using above mentioned full-bridge proportional sheet valves V1 through V4 adopting the present invention will be considered. The flow discharge characteristic QL is calculated from the following equation, $$Q_L = C_d \pi d x_v \sqrt{\frac{2(P_S - P_L)}{\rho}} \tag{12}$$

where Xv is a valve opening ratio of the proportional control valve. FIG. 6 shows the load flow rate characteristics of the full-bridge proportional sheet valves V1 through V4 versus the valve opening ratio Xv. As a result, comparing Eq.1 with Eq.12, it is clear that the flow rate of the full-bridge proportional sheet valve is controlled $\sqrt{2}$ times as large as that of the spool valve. The maximum output condition is the same as Eq.10. The maximum output power Wvmax is obtained from the following equation, $$W_{vmax} = \frac{2\sqrt{6}}{9\sqrt{\rho}} C_d \pi d P_s^{1.5} \tag{13}$$

The oil output power is gained $\sqrt{2}$ times as large as the control system of the spool valve.

Figures 7A, 7B, 7C, 7D, 7E:
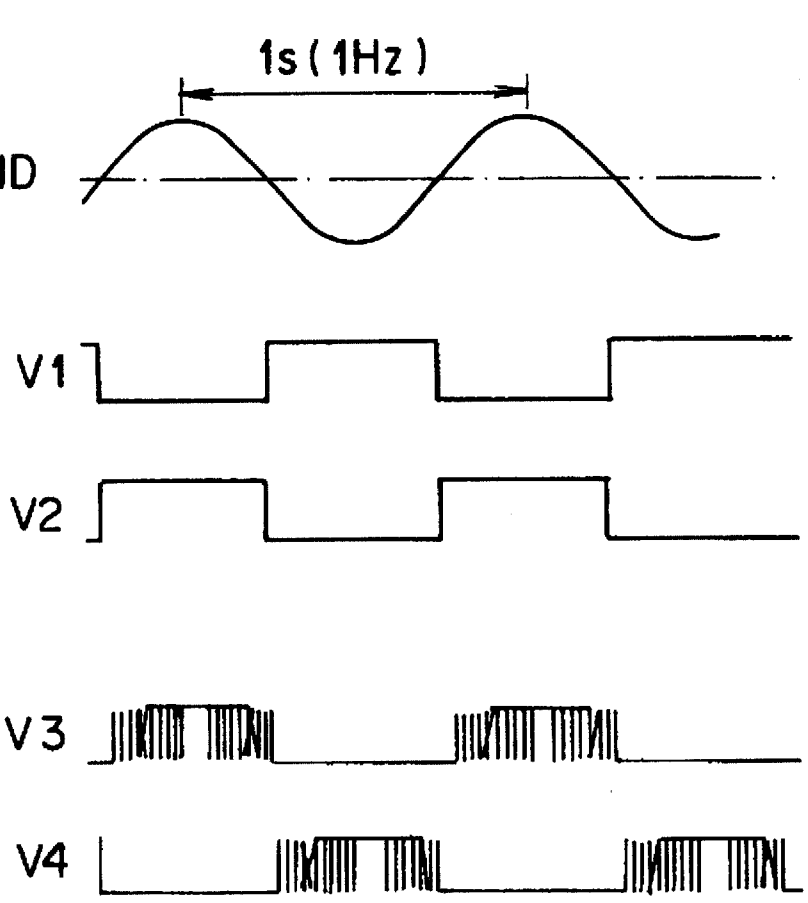
FIG. 7 shows an example of the control signal outputting to the pilot valve of the proportional sheet valve when the input signal is a circular function or a sine function adopting the present preferred embodiment.

FIG. 7 shows an example of the control signal output to each pilot valve when the input signal U is a circular function oar sine wave. It is clear that the pilot valves 8 of the proportional sheet valves V2 and V4 being in the oil supply position are operating under the turn-on-off controlling system, and that the pilot valves 8 of the proportional sheet valves V1 and V3 being in the oil delivery position are operating under the PWM controlling system.

Controlling the oil cylinder 2 using this method, it is possible that the energy efficiency is higher because that the oil pressure loss is smaller than the method using the servo valve. It is possible that the positioning control accuracy is higher because the back oil pressure is higher by the meter-out control being in the oil delivery position.

The controlling method in case of a load fluctuation being large like that of a stamping machining process will be explained. Considering the case that a load acting on the ram 1 is decreasing rapidly, such as in a stamping machining process, it becomes easy for the ram 1 to be running by inertia against a target position. Then the running by inertia is the overshoot. The overshoot causes an increasing of moving distance of the ram 1 and to dead time under control system when operating the ram 1 with high frequency. The overshoot is to be held as small as possible. The conventional hydraulic circuit using a conventional servo valve has set up the flow rate gain of the spool with cross-section ratio of an upper chamber to a lower chamber of the hydraulic cylinder. The control adopting the present invention adds the turn-on-off control system and the meter out control system as mentioned above to prevent the overshoot.

In the normal operation, the proportional sheet valves V2 and V3 are operated with the turn-on-off control system and with the meter out control system, oil pressure PU acts on the upper chamber 2U of the hydraulic cylinder 2, driving the ram 1 by the piston 10 moving downward, and a work (not shown) is stamped out. The NC controller 9 is always monitoring the speed change of the ram 1 or the piston 10, and detects the running by inertia of the ram 1 in the instance of having stamped out a work in the stamping out machining process. As soon as the NC controller 9 detects a rapidly large speed fluctuation by a speed detecting sensor, the NC controller 9 commands the pilot valve 8 of the proportional sheet valve V1 to turn-on valve V1 in order to prevent the running by inertia of the ram 1 by controlling the back pressure PL of the lower chamber 2L of the hydraulic cylinder. As soon as the ram 1 stops the NC controller commands the the proportional sheet valves V2 and V3 to turn-off and commands the pilot valve 8 of the proportional sheet valve V4 to turn-on, making the ram 1 move upward.

The method of selecting automatically the high speed operation or the large output operation dependent on the load will be explained. The controlling method is that the load of the stamping machining process is calculated from a work material, a work thickness and a tool size, by the calculated load and a machining process time setting, the NC equipment of the NC controller selects the high speed operating circuit of the ram 1 or the large output operating circuit of the ram 1, and outputs the optimal commands to the proportional sheet valves.

The large output operating circuit or the power hydraulic circuit is comprised of the same circuit as the above mentioned normal hydraulic circuit. The load is roughly calculated from the cross section of the piston 10 multiplied by the oil pressure of the upper chamber 2U. The high speed operating circuit or the speed hydraulic circuit commands the turn-on of the proportional sheet valves V1 and V2 moving the ram 1 downward and commands the turn-off of the proportional sheet valves V3 and V4. It is possible to provide effective circulation by adding the pressure oil to the upper chamber 2U of the hydraulic cylinder 2 through the proportional sheet valve V3 from the hydraulic pump 3 to (2) the delivery pressure oil to the upper chamber 2U of the hydraulic cylinder 2 through the proportional sheet valves V1 and V2 from the lower chamber 2L of the hydraulic cylinder 2; in detail, flowing from the lower chamber 2L, flowing from the T-port to the P-port of the main valve 7 of the proportional sheet valve V1, and flowing from the P-port to T-port of the main valve 7 of the proportional sheet valve V2. As a result, the normal flow rate of the hydraulic pump is increased and the downward speed of the ram 1 is increased. For example, setting up the cylinder diameter of the hydraulic cylinder 2 to 125 mm, the rod diameter to 90 mm, the downward speed of the ram 1 is 1.5 times as much as normal setting conditions. Using this hydraulic circuit, the stamping power is decreased in a case of the speed hydraulic circuit because of the output load being multiplied the cross-section of the piston 10 with the oil pressure in the upper chamber 2U of the hydraulic cylinder. In a case of upward movement of the ram 1, it commands the proportional sheet valves V1 and V3 to turn-on as same as the normal operating condition of the hydraulic circuit.

In order to prevent a stamping process from being caused not to operate because of the output load being too small in the speed hydraulic circuit by fault input data into the NC equipment, it is enough to control the ram 1 that the NC controller 9 commands the proportional sheet valves V1 through V4 to change instantly into the hydraulic circuit when the piston 10 stops before the bottom dead center by detecting a position and a velocity of the piston 10 of the hydraulic cylinder 2 or the ram 1 using a sensor 11. The above mentioned control system is a digital control using a NC controller 9. It is easy to change the operating setting conditions such as the changing of the structure of the hydraulic cylinder and the speed control of the ram 1 by the setting parameters of the NC controller 9 and the information from sensors. The digital control system has a good advantage of being noise-free and of safety.

We claim:

1. Method for controlling driving of a ram of a hydraulic cylinder of a hydraulic press equipment, wherein four proportional sheet valves are connected with a hydraulic circuit so as to form a full-bridge hydraulic circuit, said hydraulic circuit comprising a hydraulic pump and a hydraulic cylinder to make said ram of said hydraulic press equipment move upward and downward, each of said proportional sheet valves comprising a sheet-formed main valve and a pilot valve for controlling motions of said main valve, characterized in that:

in case of a machining process with a wide load fluctuation, rapidly turning-on one of said proportional sheet valves in a pressure oil supply position and flowing pressure oil into a discharge line of pressure oil from a lower chamber of said hydraulic cylinder as soon as a stamping load decreases rapidly in order to prevent said ram from overshooting a target position by increasing back pressure of a discharge line from the lower chamber of said hydraulic cylinder.

2. Method for controlling driving of a ram of a hydraulic cylinder of a hydraulic press equipment according to claim 1 comprising:

causing a pair of proportional sheet valves being in a pressure oil supply position to turn-on and causing a remaining pair of proportional sheet valves being in a pressure oil delivery position to turn-off, respectively, thereby enabling a hydraulic circuit combination to be selected, in which working speed of said hydraulic cylinder takes precedence of all other operating conditions, in accordance with a calculated working load from an operating control means, and in case of a necessary working load being larger than a calculated working load, detecting a moving speed of said ram, then arranging one of a pair of proportional sheet valves being in a pressure oil supply position to turn-off and a remaining pair of proportional sheet valves being in a pressure oil delivery position to turn-on, respectively, just before stopping of said ram, thereby enabling changing the hydraulic circuit combination.

* * * * *